US007872550B2

(12) United States Patent
Chuang et al.

(10) Patent No.: US 7,872,550 B2
(45) Date of Patent: Jan. 18, 2011

(54) VERTICAL COUPLING STRUCTURE FOR NON-ADJACENT RESONATORS

(75) Inventors: Chia-Cheng Chuang, Kaohsiung (TW); Ruey-Beei Wu, Taipei (TW); Tze-Min Shen, Chiayi (TW)

(73) Assignees: Industrial Technology Research Institute, Hsinchu (TW); National Taiwan University, Taipei (TW)

( * ) Notice: Subject to any disclaimer, the term of this patent is extended or adjusted under 35 U.S.C. 154(b) by 0 days.

(21) Appl. No.: 12/689,219

(22) Filed: Jan. 18, 2010

(65) Prior Publication Data

US 2010/0117768 A1 May 13, 2010

Related U.S. Application Data

(62) Division of application No. 11/969,920, filed on Jan. 7, 2008, now Pat. No. 7,675,391.

(30) Foreign Application Priority Data

Jun. 27, 2007 (TW) ..... 96123207 A

(51) Int. Cl.
*H01P 5/02* (2006.01)
*H01P 3/16* (2006.01)

(52) U.S. Cl. ..... 333/208; 333/248; 333/254

(58) Field of Classification Search ..... 333/202, 333/208, 209, 210, 211, 212, 219, 219.1, 333/227, 230, 239, 248, 249, 254
See application file for complete search history.

(56) References Cited

U.S. PATENT DOCUMENTS 4,901,040 A * 2/1990 Ahlborn et al. ..... 333/26

* cited by examiner

*Primary Examiner*—Stephen E Jones
(74) *Attorney, Agent, or Firm*—Jianq Chyun IP Office

(57) ABSTRACT

A vertical coupling structure for non-adjacent resonators is provided. The vertical coupling structure has a first resonator and a second resonator. At least one side of the first resonator is formed as a first bent extension structure, and the first bent extension structure includes a slot. The second resonator is not adjacent to the first resonator, and the side of the second resonator opposite to the first bent extension structure of the first resonator further includes a slot, such that the two sides are electrically connected.

7 Claims, 14 Drawing Sheets

VERTICAL COUPLING STRUCTURE FOR NON-ADJACENT RESONATORS

CROSS-REFERENCE TO RELATED APPLICATION

This application is a divisional application of and claims priority benefit of an application Ser. No. 11/969,920, filed on Jan. 7, 2008, now allowed, which claims the priority benefit of Taiwan application serial no. 96123207, filed on Jun. 27, 2007. The entirety of each of the above-mentioned patent applications is hereby incorporated by reference herein and made a part of this specification.

BACKGROUND OF THE INVENTION

1. Field of the Invention

The application generally relates to a coupling structure of resonators, and more particularly, to a coupling structure of non-adjacent resonators.

2. Description of Related Art

In a wireless communication system, frequency selection elements, such as filters, duplexers, multiplexers and so on, are necessary key elements for radio-frequency front-end circuits. The frequency selection elements have functions for selecting or filtering/attenuating signals or noise in a specific frequency range in a frequency domain, so that rear-end circuits can receive signals in a correct frequency range and process the signals.

In the frequency ranges of microwave (1 GHz-40 GHz) and millimeter wave (40 GHz-300 GHz), the entire radio-frequency front-end circuits are formed of waveguide tubes in a large system. A waveguide tube has advantages of high-power endurance and extremely low loss, but its minimal size is limited because of its cut-off frequency. In addition, the waveguide tube is manufactured in non-batch method by precision work, and thus, high cost limits the application coverage of the waveguide tube.

Japanese Patent Application Laid-Open Publication No. 06-053711 provides a high-frequency signal transmission structure of an equivalent waveguide tube, which is formed by a circuit board structure. As shown in FIG. 1, the structure is called as a substrate integrated waveguide (SIW), whose basic structure comprises a dielectric layer 3 and conductor layers 1 and 2. The SIW structure has advantages of low-cost and integration with plane circuits since the SIW can be implemented by using a general circuit board or other multi-layered plane structures, such as low temperature cofired ceramic (LTCC), thereby. However, the SIW is formed of a multilayer board, thus its thickness is limited. Generally, the thickness is about several tens of mils, and the width is generally several hundreds of mils or more due to the restriction of the cut-off frequency (waveguide tube) or the resonant frequency (resonant cavity). The width-high ratio is usually greater than 10, and the width-high ratio for a conventional hollow waveguide tube is about 2. In comparison with the conventional waveguide tube, SIW with high width-high ratio may result in the following results. First, a flatter structure may result in higher metal-loss in the same width and the same transmission frequency, and therefore, the quality factor of the resonator is restricted. Second, in a flat structure, a number of resonators can be arranged in a vertical stack mode that occupies less area, so that the flat structure has advantages of small volume and high performance.

The coupling manner of a multi-stage resonator filter is related to the resonant mode and relative positions of the resonators. Nowadays, the staggered coupling manner using the SIW structure is to use a plane linear arrangement structure with an additional coupling mechanism, which is as shown in FIG. 2 (referring to X. Chen, W. Hong, T. Cui, Z. Hao and K. Wu, "Substrate integrated waveguide elliptic filter with transmission line inserted inverter", *Electronics Letter*, Vol. 41, issue 15, 21 Jul. 2005, pp. 851-852), a plane U-shape arrangement shown in FIG. 3 (referring to Sheng Zhang, Zhi Yuan Yu and Can Li, "Elliptic function filter designed in LTCC", *Microwave Conference Proceedings,* 2005. *APMC. Asia-Pacific Conference Proceedings*, Vol. 1, 4-7 Dec. 2005) or a vertical U-shape arrangement shown in FIG. 4 (referring to Zhang Cheng Hao; Wei Hong; Xiao Ping Chen; Ji Xin Chen; Ke Wu; Tie Jun Cui, "Multilayered substrate integrated waveguide (MSIW) elliptic filter", *IEEE Microwave and Wireless Components Letters*, Vol. 15, Issue 2, February 2005 Page(s): 95-97). For SIW structure, resonators in a linear arrangement are not efficient, and the additional coupling mechanism is too long which is disadvantageous for the multi-stage filter. Regardless of plane or vertical bending structure for the U-shape arrangement and taking a filter with four resonators as an example, the first resonator should be adjacent to the fourth resonator in order to form the staggered coupling structure. As a result, such structure limits the flexibility of arrangement of the input/output port, and occupies more areas.

In summary, in conventional techniques, there is no any technique that provides a vertically-staggered coupling structure for non-adjacent resonators. The conventional techniques limit the flexibility of the input/output port, and occupy more areas.

Additionally, for the design of current filters, a transmission zero (TZ) is formed by using the coupling between non-adjacent resonators in a main coupling path (that is, a staggered coupling). When the TZ is set at a proper frequency, a larger amount of signal attenuation can be obtained; that is, the same attenuation amount can be obtained by using fewer stages, so that the pass-band loss is lower, and the volume is smaller. However, as described above, there is no design to efficiently form coupling between non-adjacent resonators. Thus, it is necessary for those of skill in the art to provide an efficient staggered coupling structure for non-adjacent resonators.

SUMMARY OF THE INVENTION

Accordingly, the application provides a coupling structure with vertically-stacked resonators, which is suitable for SIW structure. Such structure has the function for providing additional transmission zero points. The frequency selection elements with above characteristics have the advantages of low cost, small volume and good performance.

Accordingly, the application provides a vertical coupling structure for non-adjacent resonators. The vertical coupling structure comprises a first resonator and a second resonator. At least one side of the first resonator is formed as a first bent extension structure, and the first bent extension structure comprises a slot. The second resonator is not adjacent to the first resonator, and the side of the second resonator opposite to the first bent extension structure of the first resonator further comprises a slot, such that the two sides are electrically connected.

As described above, the application provides several coupling structures for cross layers when the resonators are vertically stacked. These structures are compliant with the existing multilayer substrate process, and can be easily designed and implemented. Therefore, the performance of the frequency selection element can be increased without adding cost.

These and other exemplary embodiments, features, aspects, and advantages of the application will be described and become more apparent from the detailed description of exemplary embodiments when read in conjunction with accompanying drawings.

BRIEF DESCRIPTION OF THE DRAWINGS

The accompanying drawings are included to provide a further understanding of the application, and are incorporated in and constitute a part of this specification. The drawings illustrate embodiments of the application and, together with the description, serve to explain the principles of the application.

DESCRIPTION OF THE EMBODIMENTS

Figure 1:
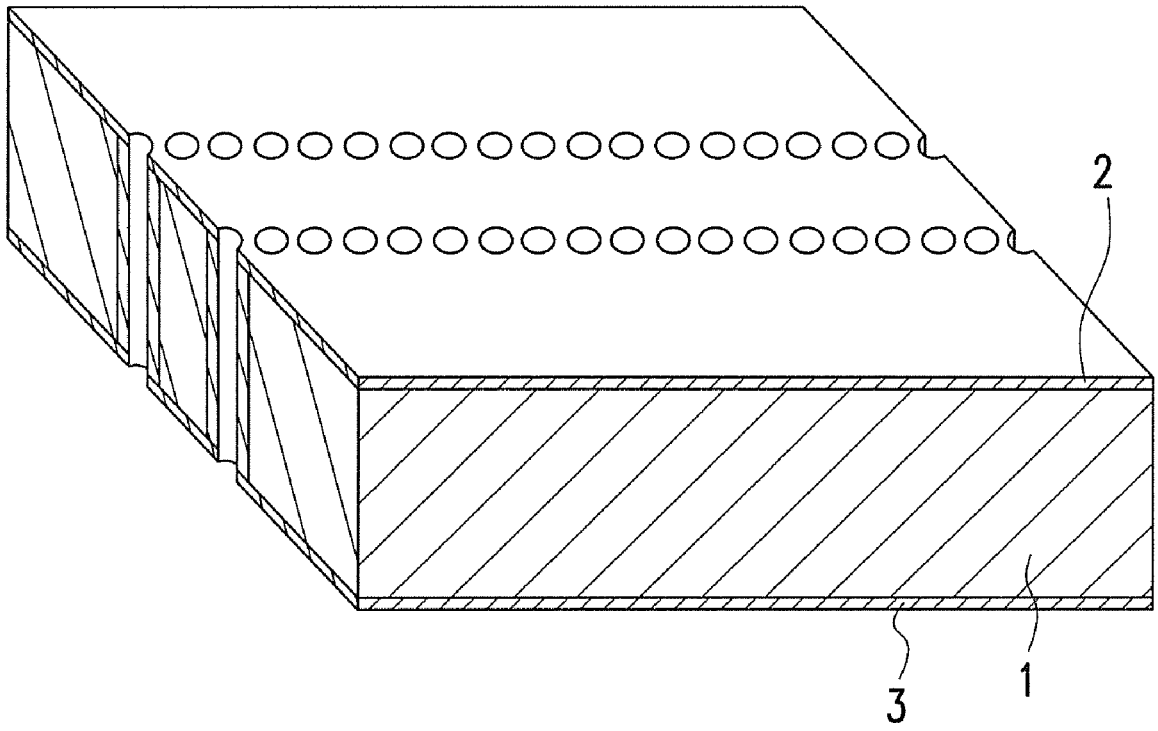
FIG. 1 (PRIOR ART)
FIG. 1 is a schematic diagram illustrating the high-frequency signal transmission structure of equivalent waveguide tubes formed by using circuit board structure in conventional techniques.
Figure 2:
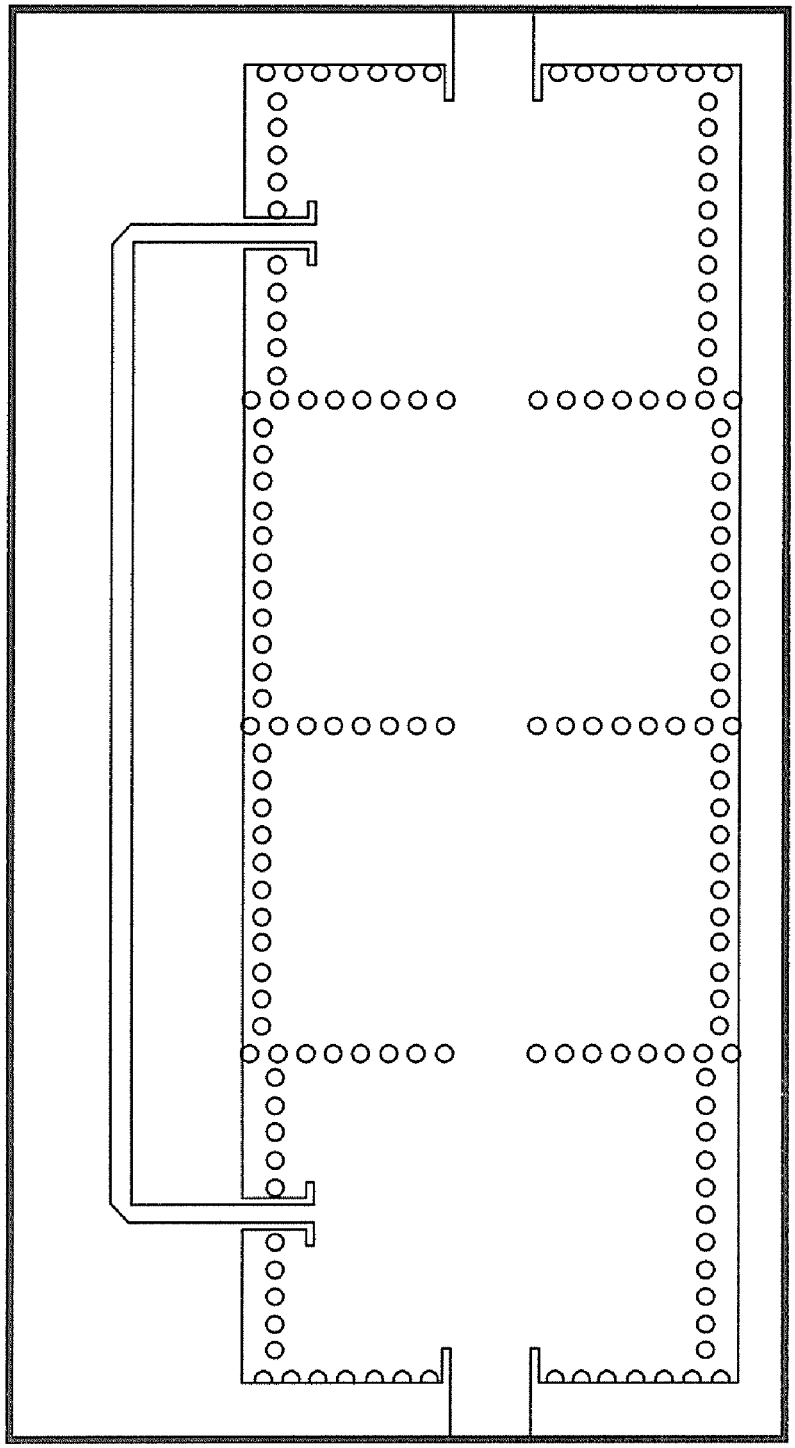
FIG. 2 (PRIOR ART)
FIG. 2 is a schematic diagram illustrating a plane linear arrangement structure with additional coupling mechanism according to the conventional techniques.
Figure 3:
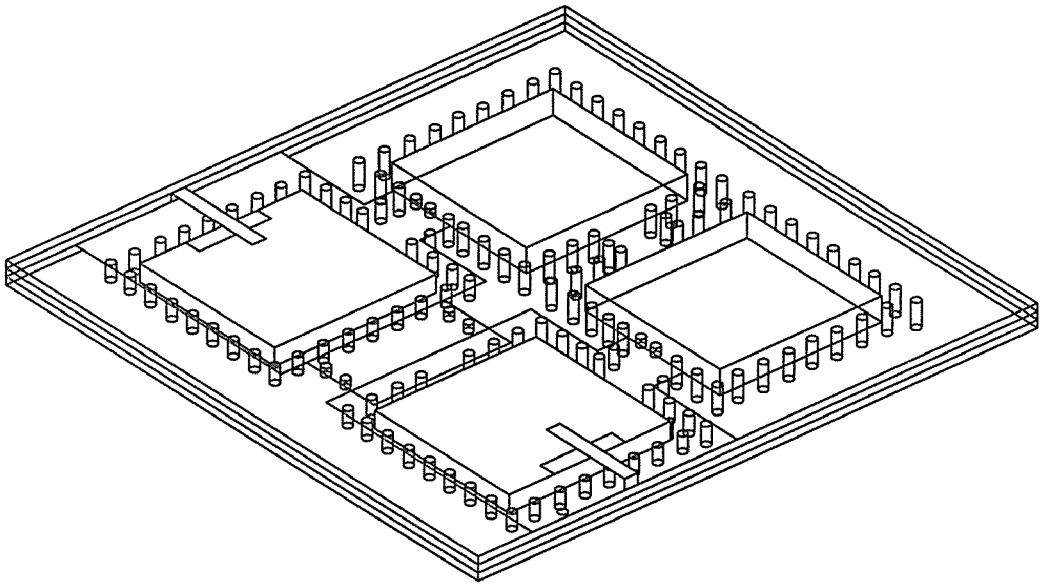
FIG. 3 (PRIOR ART)
FIG. 3 is a schematic diagram illustrating the coupling mechanism of the plane U-type arrangement according to the conventional techniques.
Figure 4:
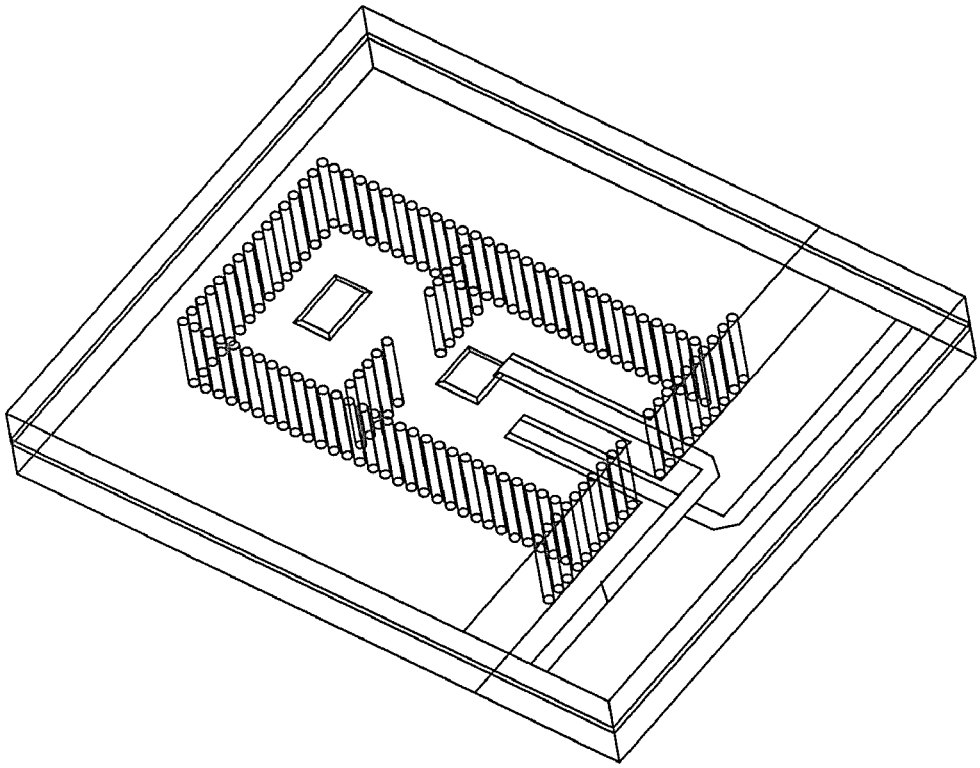
FIG. 4 (PRIOR ART)
FIG. 4 is a schematic diagram illustrating the coupling mechanism of the vertical U-type arrangement according to the conventional techniques.
Figure 5:
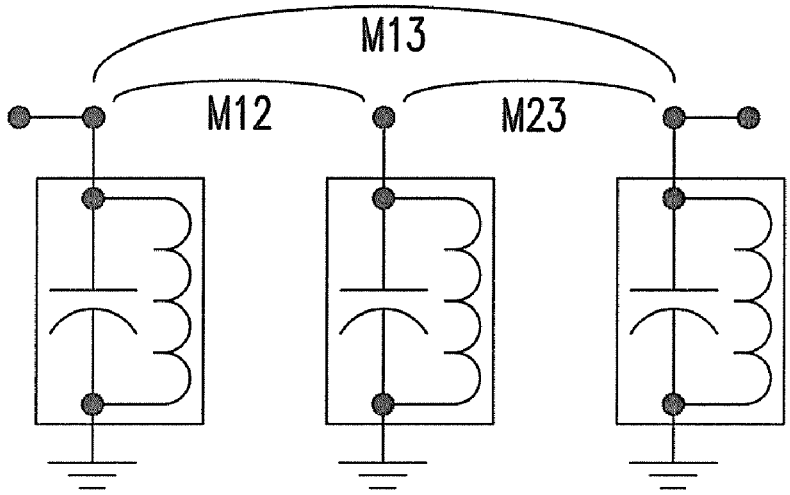
FIG. 5 is a schematic diagram illustrating a simplified circuit of a three-stage band-pass filter with staggered coupling structure according to one embodiment of the application.

A band-pass filter circuit and its coupling mechanism will be described. FIG. 5 shows a simplified circuit configuration of a three-stage band-pass filter with staggered coupling structure according to one embodiment of the application. Referring to FIG. 5, the structure comprises three resonators, two main coupling mechanisms (M12, M23) and one weak staggered coupling mechanism (M13). The polarities of the coupling mechanisms $M\alpha\beta$ ($\alpha$, $\beta$=1, 2, 3, $\alpha\neq\beta$) are defined as that the polarity for the magnetic field coupling is positive, and the polarity for the electric field coupling is negative. In this case, if M12, M23 and M13 are all magnetic field couplings, a transmission zero is formed at a frequency lower than the pass band. If M12 and M23 are magnetic field couplings and M13 is an electric field coupling, a transmission zero is formed at a frequency higher than the pass band. In order to comply with different specifications, the coupling types between resonators can be varied, so that the transmission zero can be set at a proper frequency.

Figure 6:
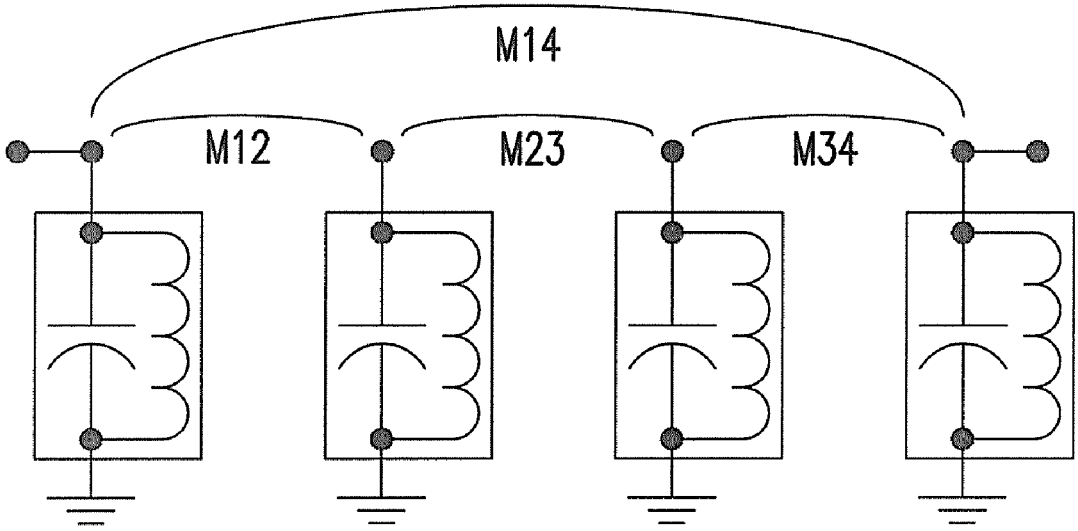
FIG. 6 is a schematic diagram illustrating a simplified circuit of a four-stage band-pass filter with staggered coupling structure according to one embodiment of the application.

FIG. 6 shows a simplified circuit configuration of a four-stage band-pass filter with staggered coupling structure according to another embodiment of the application. As shown in FIG. 6, the structure comprises four resonators, three main coupling mechanisms (M12, M23 and M34) and one weak staggered coupling mechanism (M14). Here, the polarities of the coupling mechanisms $M\alpha\beta$ ($\alpha$, $\beta$=1, 2, 3,4, $\alpha\neq\beta$) are also defined in the same way. The polarity for the magnetic field coupling is defined as positive, and the polarity for the electric field coupling is defined as negative. In this case, if M12, M23 and M34 are magnetic field couplings, and M14 is an electric field coupling, there are two transmission zeros respectively at the high-frequency end and the low-frequency end of the pass-band frequency. If M12, M23, M34 and M14 are all magnetic field couplings, there is no transmission zero.

Figure 7:
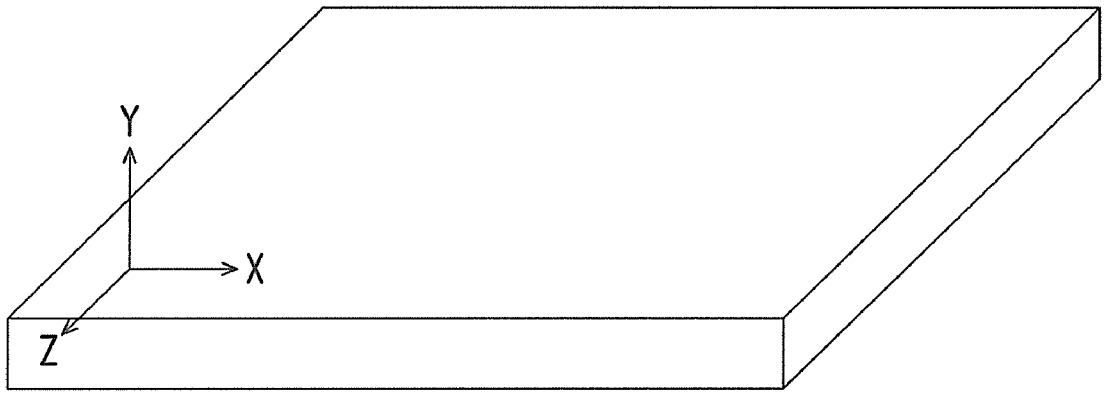
FIG. 7 is a schematic diagram illustrating the resonators formed by using a general substrate integrated waveguide.

FIG. 7 schematically shows resonators of a general substrate integrated waveguide (SIW) type. Generally, most of the SIW resonator structures have cubic geometric structure. As shown in FIG. 7, the size in Y-direction is much smaller than the size in X-direction and Z-direction. For most conditions, the SIW type resonators are operated at TE 101 mode. In the TE 101 mode, since no significant variation in the electromagnetic field is occurred at the Y-direction, the electromagnetic field can be treated as being distributed on the XZ-plane. The electric field at the center of the XZ-plane is strongest, and the magnetic field at the edges of the XZ-plane is strongest. If it is necessary to form an effect of an electric field coupling for adjacent two resonators in the Y-direction, an opening can be formed at the center of the XZ-plane. In addition, if it is necessary to form an effect of a magnetic field coupling for adjacent two resonators in the Y-direction, an opening can be formed at the edges of the XZ-plane.

Figure 8:
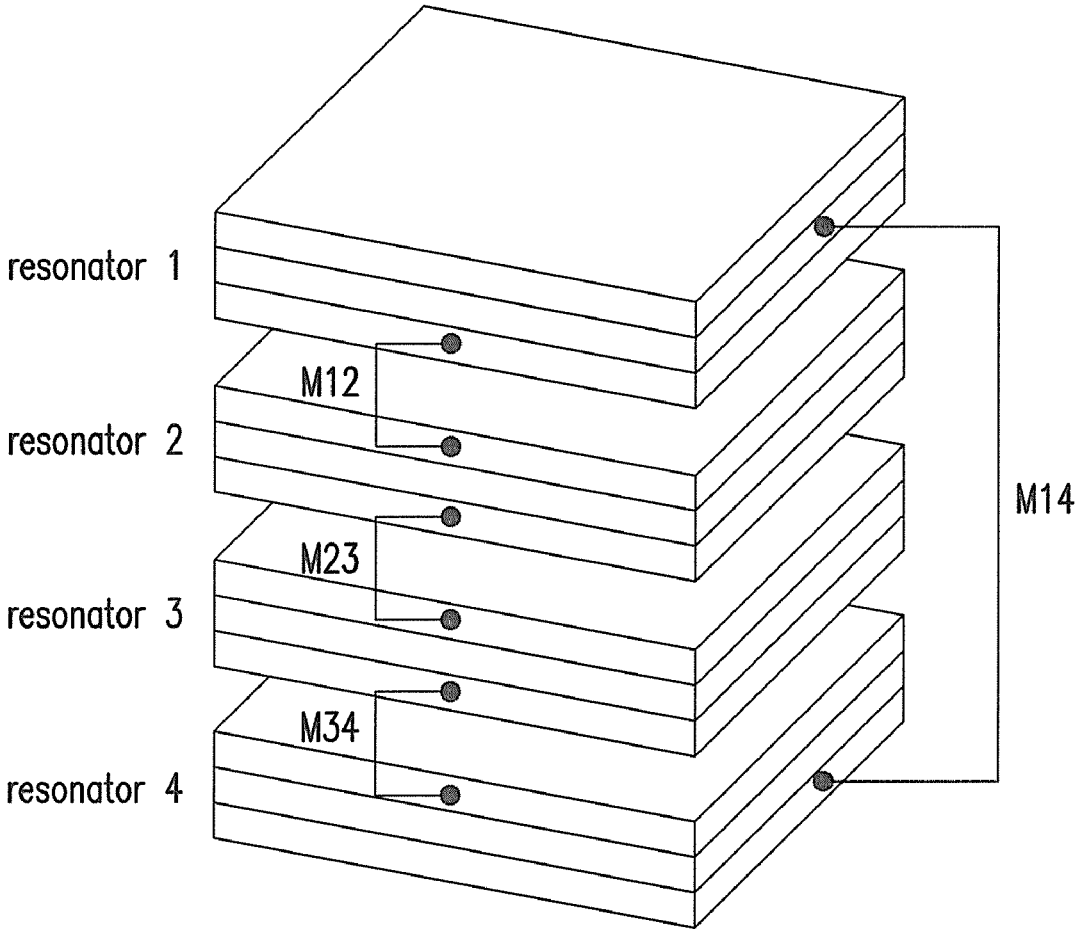
FIG. 8 is a schematic diagram illustrating the resonator arrangement and the coupling mechanism in FIG. 6.

FIG. 8 is a schematic view illustrating the resonator arrangement and the coupling mechanism in FIG. 6. As shown in FIG. 8, the filter circuit has four-stage band-pass filters with staggered coupling structure, and comprises four resonators 1 to 4. Each of the four resonators 1 to 4 comprises one or more layered medium (dielectric) substrate, two adjacent resonators are separated by a metal surface (not shown). The four resonators 1 to 4 are vertically stacked, and a slot is formed on the separation metal surface (not shown, referring to the following embodiments) so as to form coupling structures (M12, M23 and M34). The position of the slot can be properly selected to form an electric field coupling structure or a magnetic field coupling structure. For example, forming the slot at the center position can create an electric field coupling effect, while forming the slot at the edge position can create the magnetic field coupling effect.

In the embodiment shown in FIG. 8, the coupling between the resonator 1 and the resonator 4 is a staggered coupling. Because the two resonators 1 and 4 are not adjacent, it is not impossible to form a coupling structure by forming a slot in the metal layer that separates adjacent resonators. FIG. 10 to FIG. 14 show several exemplary structures for such staggered coupling structure to explain the staggered coupling (M14) between the resonators 1 and 4.

Figure 9:
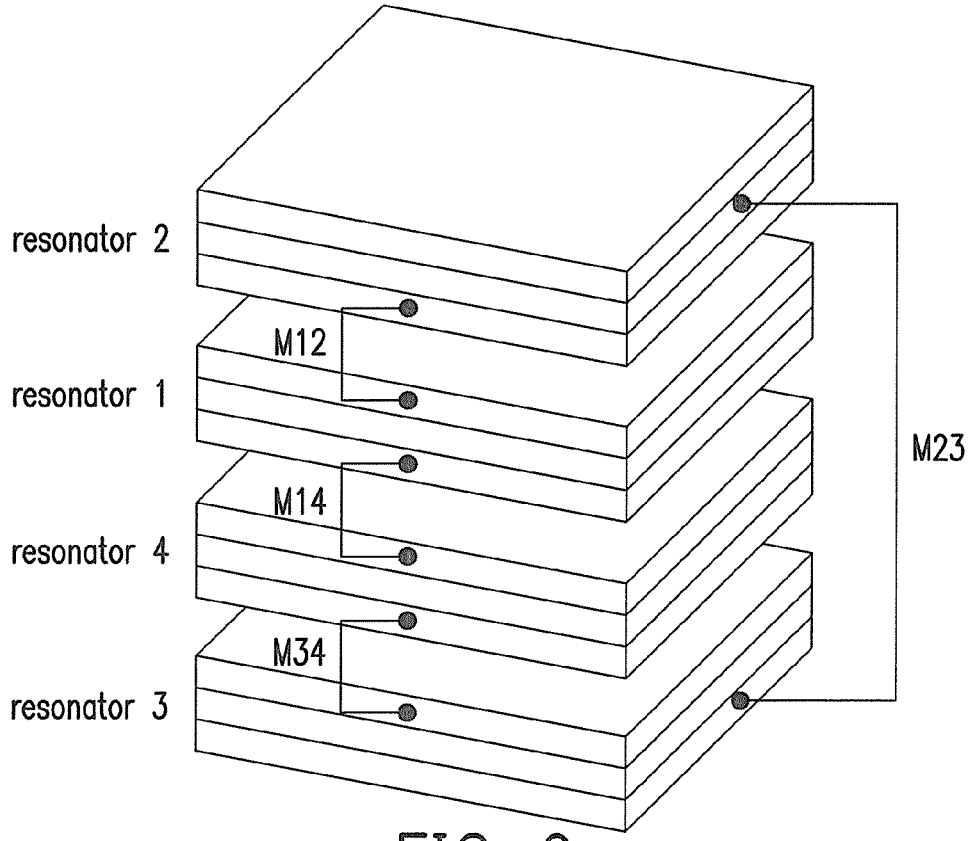
FIG. 9 is a schematic diagram illustrating the resonator arrangement and the coupling mechanism of another four-stage band-pass filter with staggered coupling structure.

FIG. 9 is a schematic diagram illustrating the resonator arrangement and the coupling mechanism of a four-stage band-pass filter with staggered coupling structure. The arrangement order and the positions of input/output ports for the resonators in FIG. 9 are different from those in FIG. 8. As shown in FIG. 9, the resonator 2, the resonator 1, the resonator 4 and the resonator 3 are arranged sequentially from top to bottom. The input port is connected to the resonator 1, and the output port is connected to the resonator 4. In the four-stage band-pass filter, the main signal coupling path is: the resonator 1=> the resonator 2=> the resonator 3=> the resonator 4, in which the coupling between the resonator 2 and the resonator 3 (M23) is the coupling for non-adjacent resonators, and the coupling between the resonator 1 and the resonator 4 (M14) is the staggered coupling.

First Embodiment

Figure 10A:
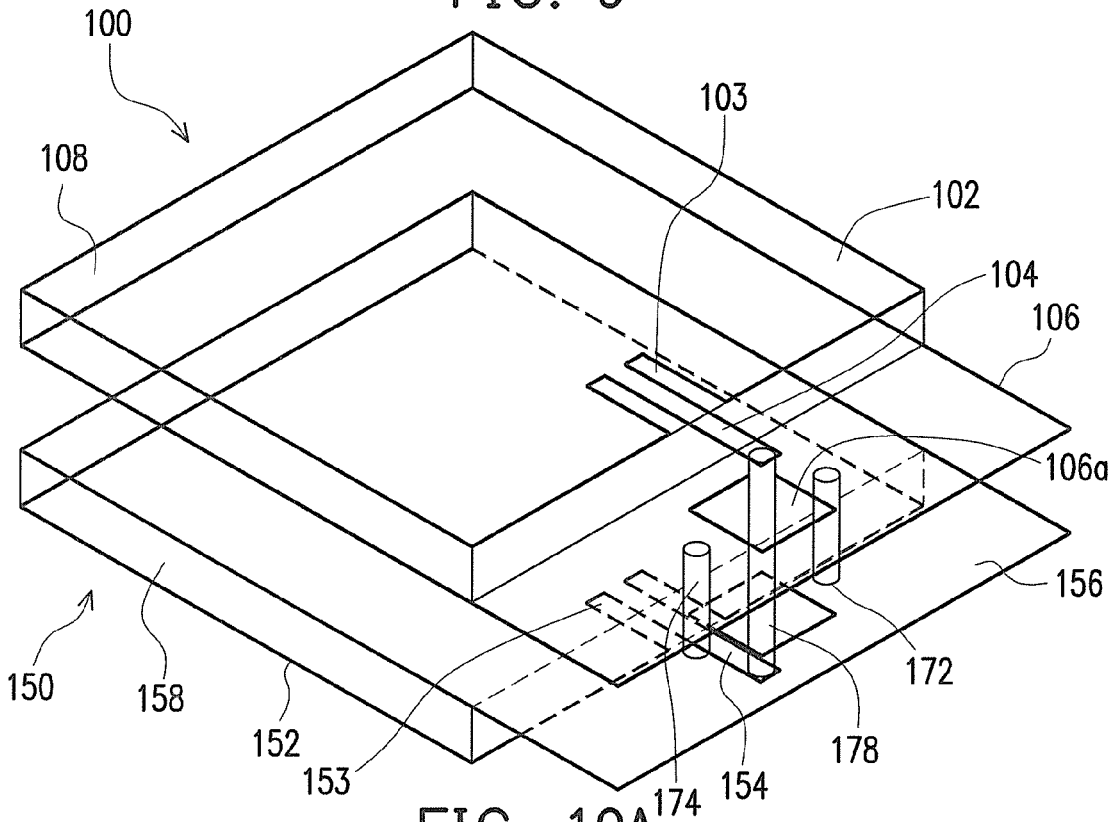
FIG. 10A is a schematic diagram illustrating a coupling structure of non-adjacent resonators according to the first embodiment of the application.
Figure 10B:
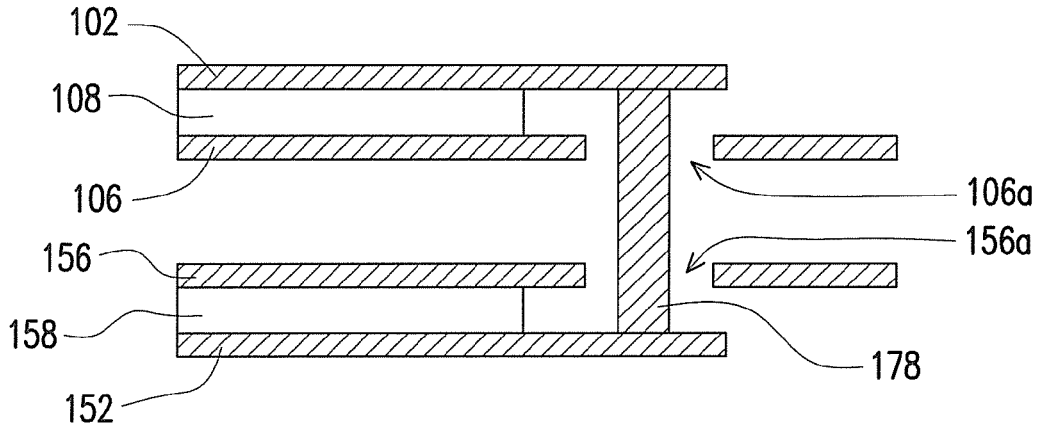
FIG. 10B is a side view illustrating the structure in FIG. 10A.
Figure 10C:
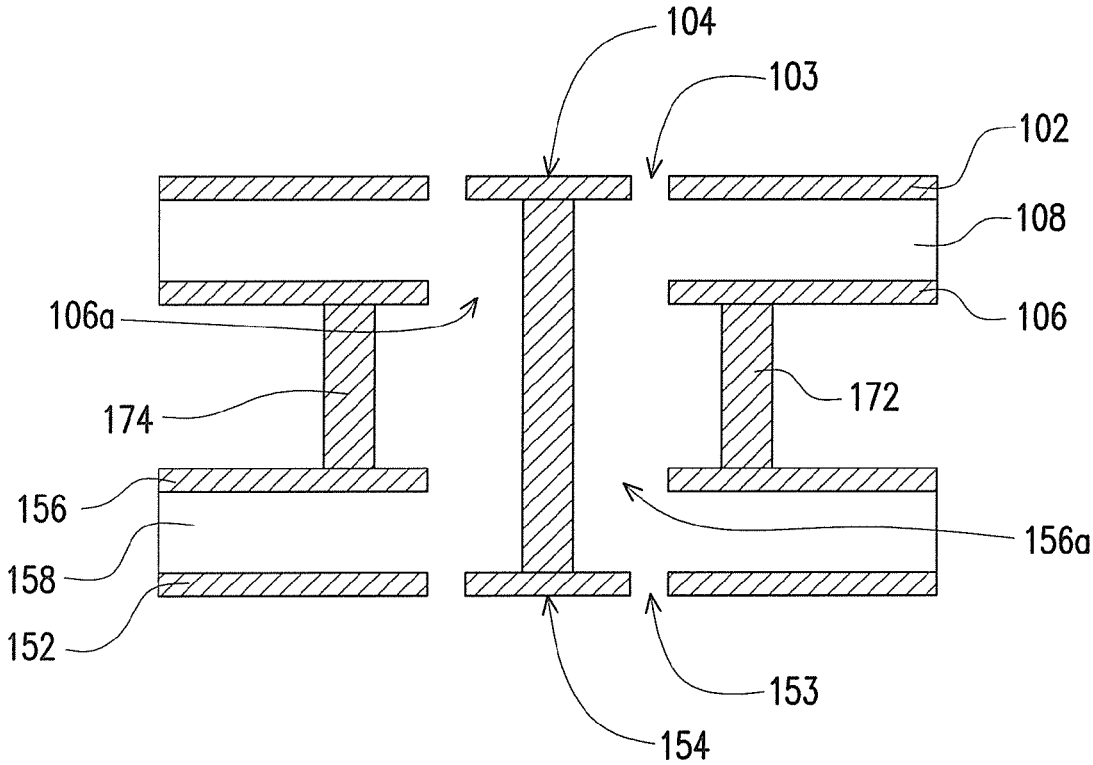
FIG. 10C is a front view illustrating the structure in FIG. 10A.

In order to achieve the coupling mechanism as shown in FIG. 8, the application provides a connection structure of a vertical staggered coupling for non-adjacent resonators. FIG. 10A is a schematic diagram illustrating a coupling structure for non-adjacent resonators according to the first embodiment of the application. FIG. 10B is a side view of the structure in FIG. 10A, and FIG. 10C is a front view illustrating the structure of FIG. 10A. In FIG. 10A, FIG. 10B and FIG. 10C, resonators between the non-adjacent resonators are omitted. Hereinafter, the upper and the lower resonators are used as an example for representing the resonators 1 and 4 in FIG. 8 respectively.

As shown in FIG. 10A, FIG. 10B and FIG. 10C, a resonator 100 (equivalent to the resonator 1) comprises a first metal layer (surface) 102, a dielectric layer 108 and a second metal layer (surface) 106. The dielectric layer 108 can be a multilayer structure, and the layer number of the dielectric layer 108 is not limited. Also, a resonator 150 (equivalent to the resonator 4) comprises a first metal layer 152, a dielectric layer 158 and a second metal layer 156. The dielectric layer 158 can a multilayer structure, and the layer number of the dielectric layer 158 is not limited.

The staggered coupling mechanism M14 as shown in FIG. 8 can be formed between the resonator 100 and the resonator 150, the two resonators are not adjacent. Other resonators can be further arranged between the resonator 100 and the resonator 150, and the dielectric layer is filled between the resonators. The embodiment focuses on the connection structure of staggered coupling mechanism between the resonator 100 and the resonator 150, the detailed structure between resonator 100 and 150 can be properly modified by those skilled in the art. Ignoring the omitted structure, the second metal layer 106 of the resonator 100 is opposite to the second metal layer 105 of the resonator 150.

As shown in FIG. 10A, a slot 103 is formed at the side edge of the first metal layer 102 of the resonator 100, and a high-frequency transmission line (hereinafter, referred to as transmission line) 104 is extended from the slot 103. In addition, a slot 153 is formed at the side edge of the first metal layer 152 of the resonator 150, and a transmission line 154 is extended from the slot 153. Basically, the position of the transmission line 104 is opposite to the position of the transmission line 154, that is, the transmission lines 104 and 154 are at the vertically projected position of each other. The transmission line 104 is electrically connected to the transmission line 154 by a via pole 178 so as to form the staggered coupling structure. In order to connect the transmission lines 104 and 154 by the via pole 178, slots 106*a* and 156*a* can be further respectively formed at the second metal layer 106 of the resonator 100 and the second metal layer 156 of the resonator 150, so that the via pole 178 can be extended from the transmission line 104 of the resonator 100, penetrated through the slot 106*a* of the resonator 100 and the slot 156*a* of the resonator 150, and then connected to the transmission line 154. The detailed structure is shown in FIG. 10B and 10C. In addition, via poles 172 and 174 can be further formed between the metal layer 106 and the metal layer 156 to electrically connect the two second metal layers 106 and 156, and the detailed structure thereof is shown in FIG. 10C.

Regarding the manufacturing process, the ordinary printed circuit board (PCB) process can be adapted for making the coupling structure. That is, stacked layers of dielectric layers and metal layers can be formed, and then a specific pattern or slot is further formed on each of the metal layers. The dielectric layers are drilled and then filled with metal material to form the via pole.

In the embodiment, the transmission lines 104 and 154 are formed by using microstripe lines, and connected through the via pole to same structure that is extended from the upper and lower resonators 100, 150. In this way, a high-frequency signal can be transmitted between two non-adjacent resonators.

Figure 11:
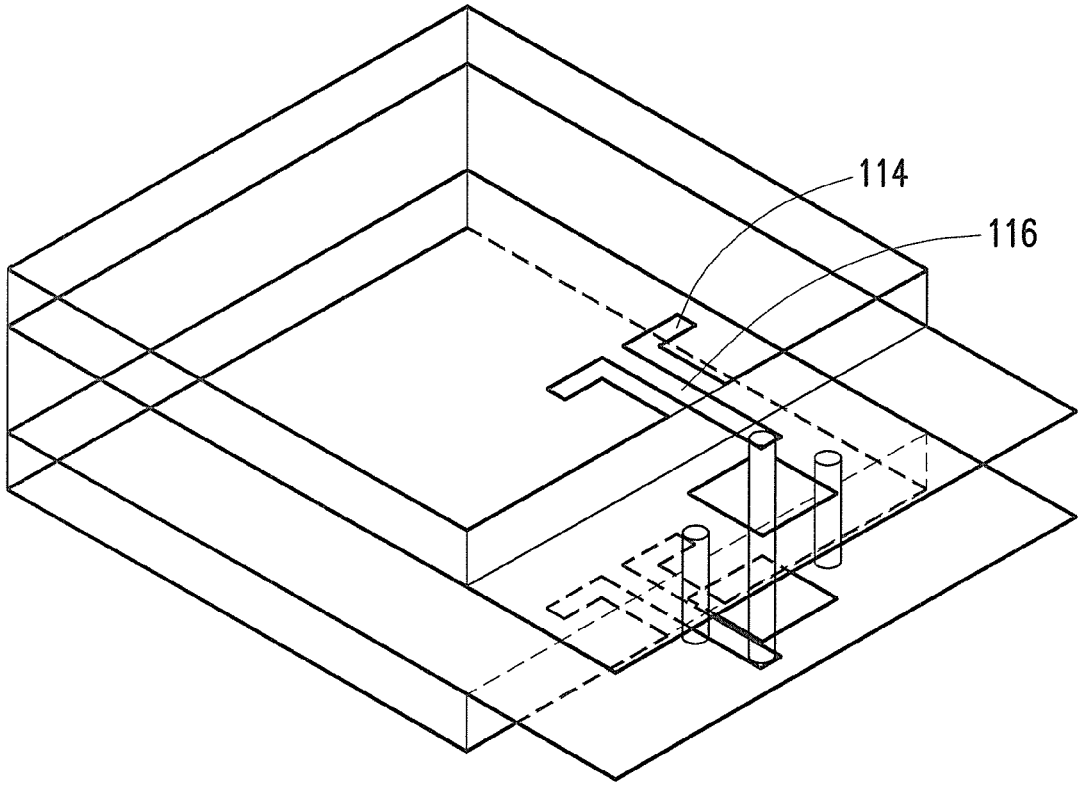
FIG. 11 is a schematic diagram illustrating the coupling structure variations of FIG. 10.

FIGS. 11 to 14 are schematic diagrams illustrating the coupling structures of non-adjacent resonators of variations of FIG. 10. FIG. 11 is a schematic diagram illustrating a coupling structure of non-adjacent resonators according to another embodiment of the application. FIG. 10 and FIG. 11 have the same function, but slightly different to each other in their structures. The difference between FIGS. 10 and 11 is the shape of the slot formed on the metal layer. As shown in FIG. 11, a slot 114 is formed at the edge of the metal layer, and substantially in a T shape. If the size of the slot in FIG. 11 is made larger, the efficiency of coupling can be further increased. The other potion of the coupling structure in FIG. 11 is the same as those in FIG. 10, and the detailed description is omitted.

Figure 12:
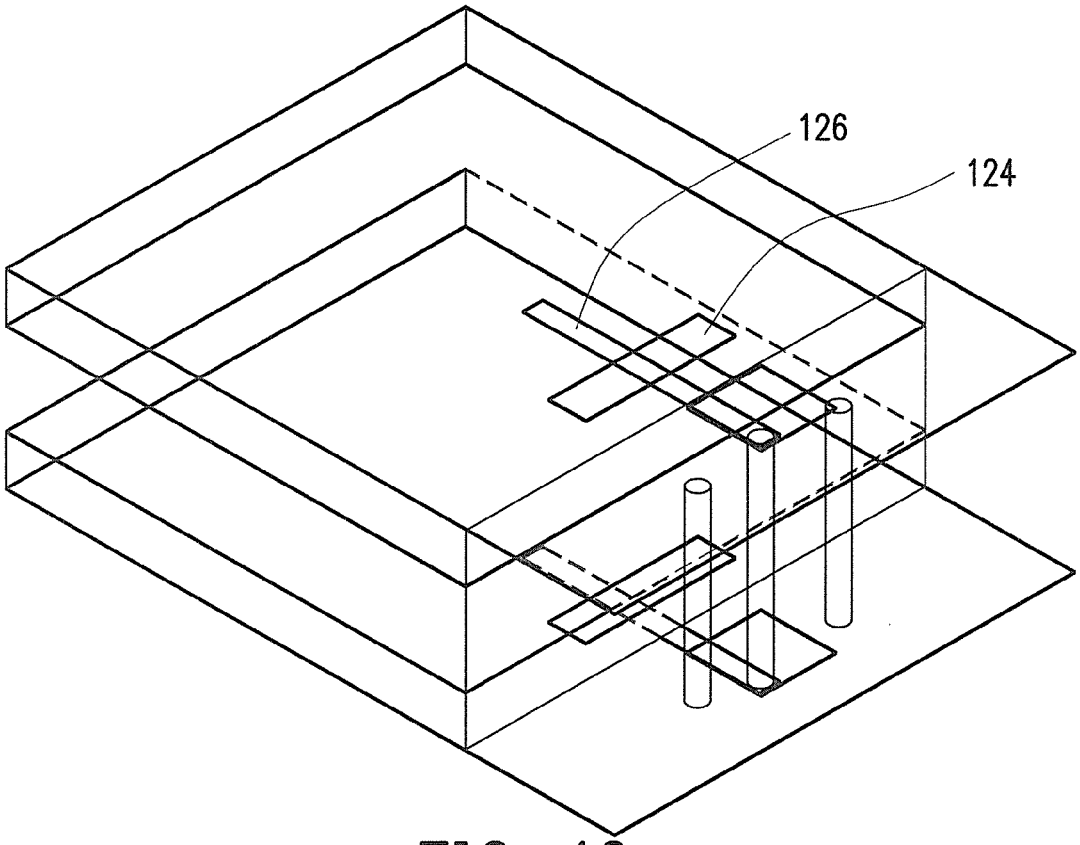
FIG. 12 is a schematic diagram illustrating another variation of FIG. 10.

FIG. 12 is a schematic diagram illustrating a coupling structure of non-adjacent resonators according to another embodiment of the application. The structure of the transmission line in FIG. 12 is different from that in FIG. 10 or FIG. 11. FIGS. 10 and 11 show a structure that an open slot formed at the edge of the metal layer and the transmission line is extended from the slot. FIG. 12 shows a slot 124 that is formed at the edge of the metal layer and is a closed slot, and a transmission line is formed on the slot 124. The transmission lines of the two resonators are also connected by a via pole to effect transmitting high-frequency signals.

Figure 13:
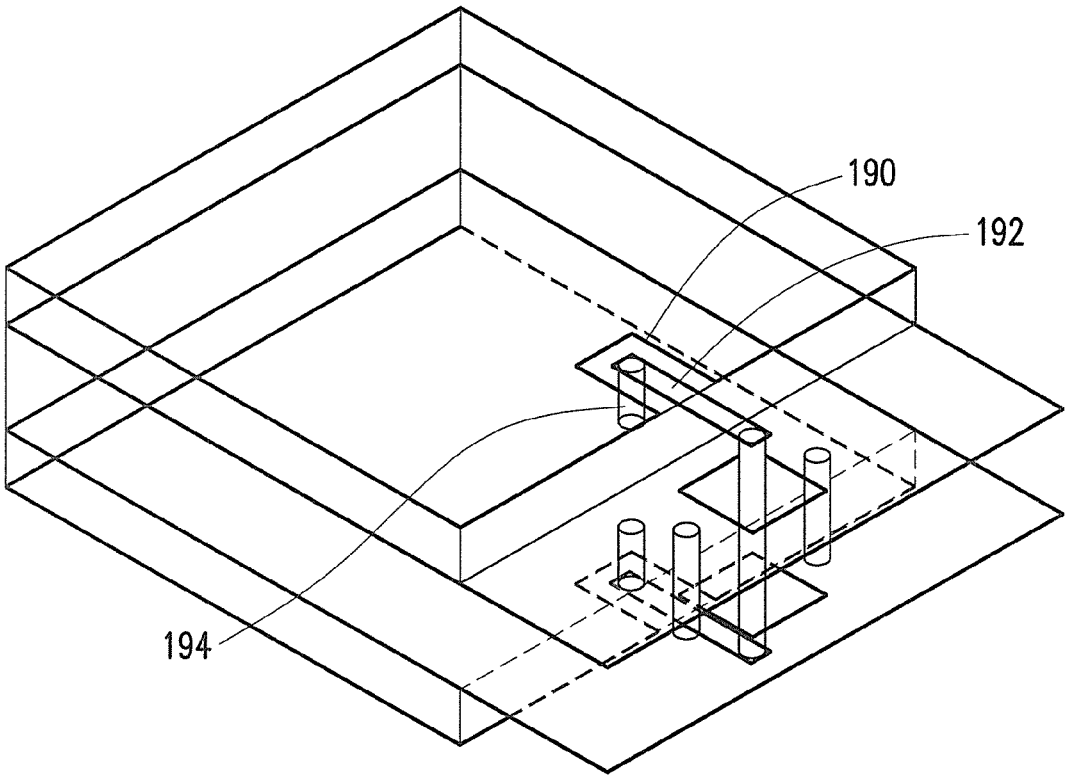
FIG. 13 is a schematic diagram illustrating another variation of FIG. 10.
Figure 14:
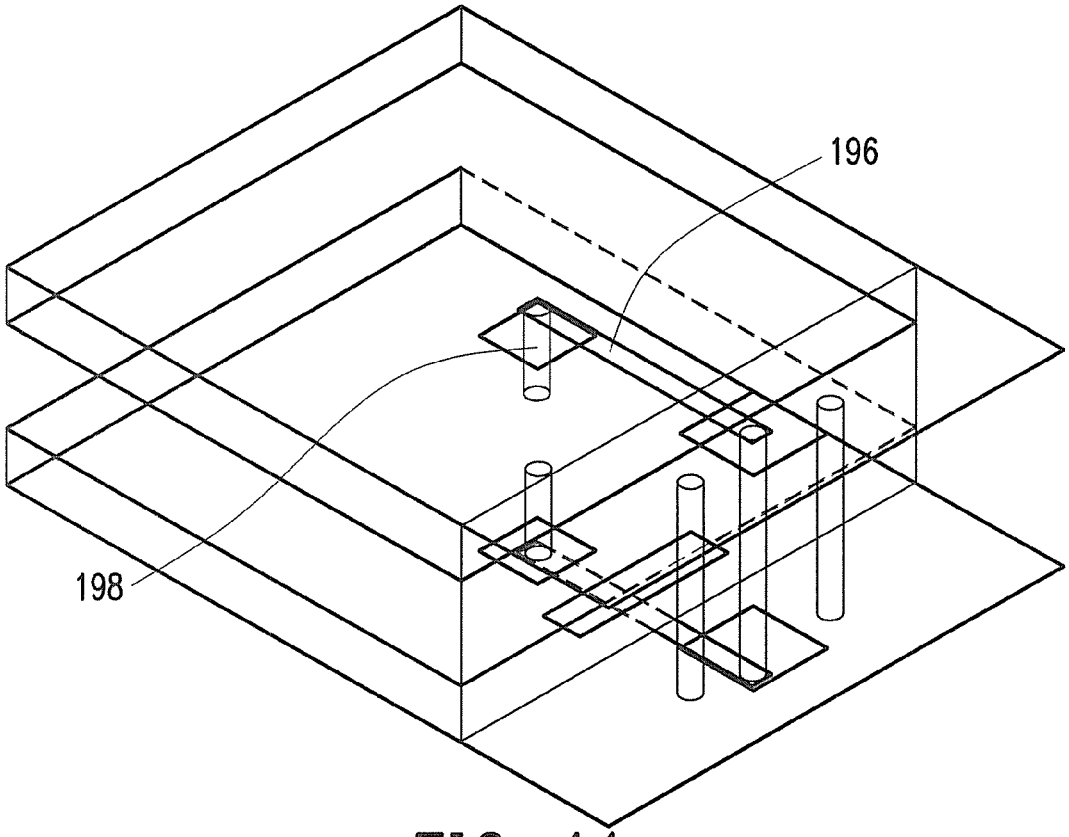
FIG. 14 is a schematic diagram illustrating another variation of FIG. 10.

FIGS. 13 and 14 are schematic diagrams illustrating coupling structures of non-adjacent resonators according to other embodiments of the application, in which a microstripe line is coupled to a resonator by a current probe. As shown in FIG. 13, basically differing from the structure in FIG. 10, a transmission line 192 is isolated from a metal layer (corresponding to the first metal layer 102 in FIG. 10) by a slot 190, and one end of the transmission line is connected to another metal layer of the resonator (corresponding to the first metal layer 106 in FIG. 10) by a current probe 194, while the other end of the transmission line is also connected to the transmission line of the lower resonator. FIG. 14 also shows a coupling structure of non-adjacent resonators with a current probe. The difference is in that FIG. 13 shows a structure of the transmission line and the resonator being formed on the same layer, while FIG. 14 shows a structure of the transmission line being disposed over the metal layer of the resonator.

In the above structures shown in FIGS. 10 to 14, the coupling phase can be adjusted by changing the length of the transmission line. In addition, the transmission line can be any applicable structure, such as a microstripe line, a stripe line, a coplanar waveguide, a slot line, a coaxial line or a waveguide tube and so on.

Second Embodiment

Figure 15A:
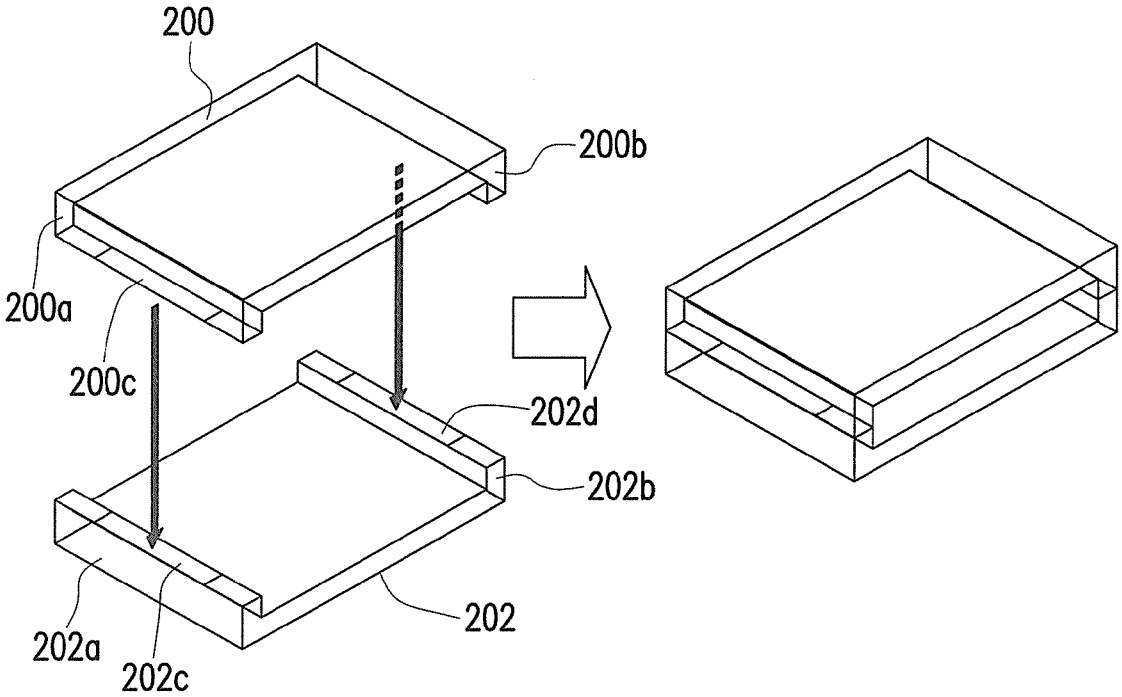
FIG. 15A is a schematic diagram illustrating a coupling structure of non-adjacent resonators according to the second embodiment of the application.

FIG. 15A is a schematic diagram illustrating a coupling structure of non-adjacent resonators according to the second embodiment of the application. In the embodiment, the coupling structure is formed by a bent extension structure of the resonator. As shown in FIG. 15A, two side edges of a resonator 200 are formed as bent extension structures 200*a* and 200*b*. In addition, a slot 200*c* is formed in the extension structure 200*a*, and another slot (not shown) is also formed in the extension structure 200*b*. Likewise, two side edges of a resonator 202 are formed as bent extension structures 202*a* and 202*b*, and slots 202*c* and 202*d* are respectively formed in the extension structure 202*a* and 202*b*. Next, the bent extension structures 200*a* and 200*b* of the upper resonator 200 are respectively connected to the bent extension structures 202*a* and 202*b* of the lower resonator 202 to form a dual-side coupling structure as shown at the right of FIG. 15A. In the embodiment, the magnetic coupling structure is formed by forming the slots (for example, 200*c* and 202*c*) in the longitudinal metal surfaces contacted to the resonators 200 and 202.

Figure 15B:
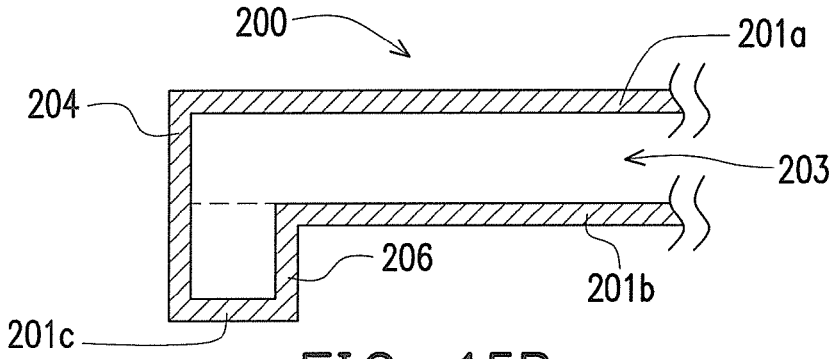
FIG. 15B and FIG. 15C are schematic diagrams illustrating the process of forming bent extension structure.
Figure 15C:
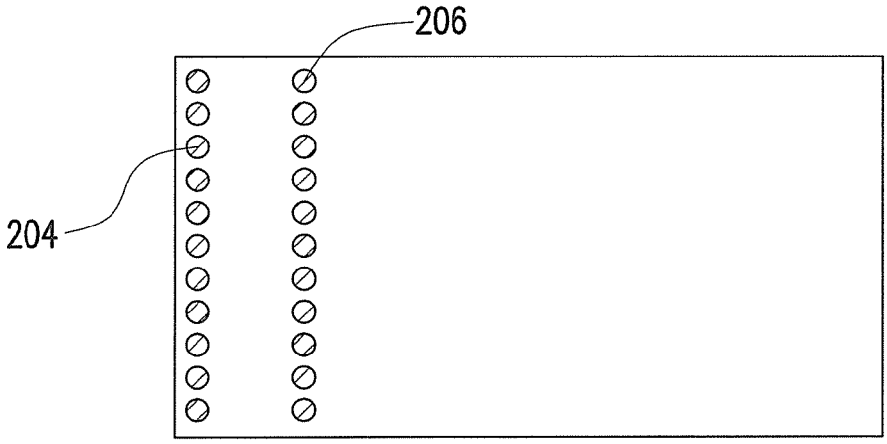

The method of forming the bent extension structure as shown in FIG. 15A will be described with reference to FIG. 15B and 15C. A stack structure of metal layers 201*a*, 201*b*, 201*c* and a dielectric layer 203 is formed, so as to form a resonator 200. As shown in FIG. 15C, plural openings are formed at the left side of the resonator 200, and then the openings are filled with metal materials to form via poles 204 and 206. By forming different heights of the via poles 204, 206, and the bent extension structures 200*a*, 200*b*, 202*a* and 202*b* are formed.

Figure 16A:
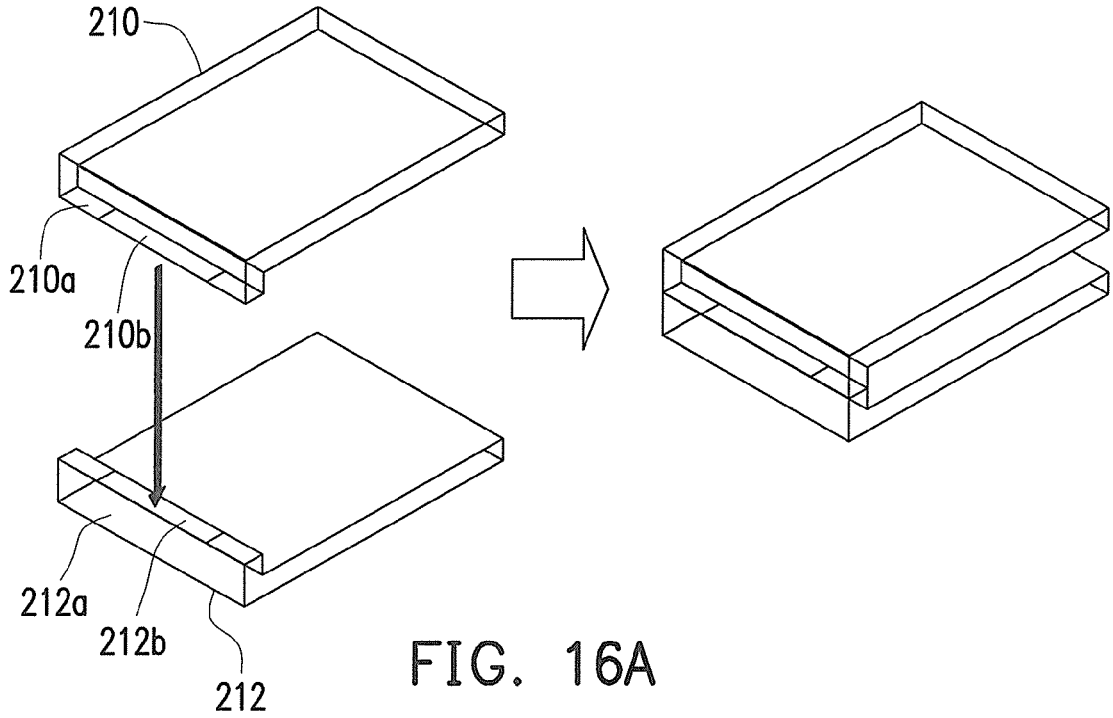
FIG. 16A is a schematic diagram illustrating a coupling structure variation of FIG. 15A.

FIG. 16A is a schematic diagram showing a variation of the coupling structure of FIG. 15A. The coupling structure shown in FIG. 15A is a dual-side coupling structure, and the coupling structure shown in FIG. 16A is a single-side coupling structure. That is, in FIG. 16A, only one bent extension structure 210*a* is formed at the edge of a resonator 210, and a slot 210*b* is formed in the bent extension structure 210*a*. Likewise, only one bent extension structure 212*a* is formed at the corresponding edge of a resonator 212, and a slot 212*b* is formed in the bent extension structure 212*a*, where the slot 210*b* is opposite to the slot 212*b* so as to form the magnetic coupling structure.

Figure 16B:
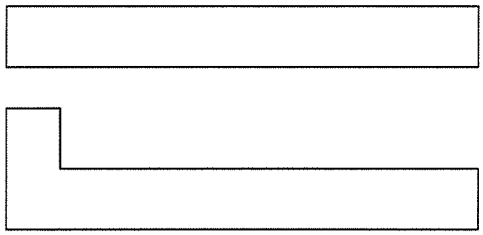
FIG. 16B to 16D are schematic diagrams illustrating coupling structure variations of FIG. 16A.
Figure 16C:
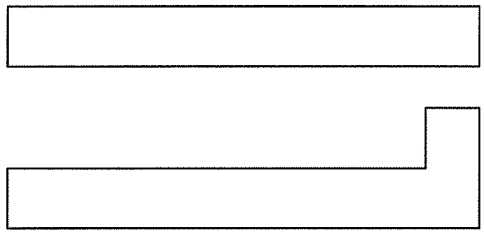
Figure 16D:
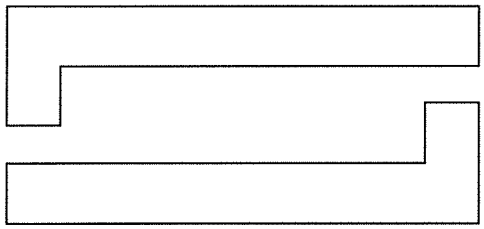

FIGS. 16B-16D are schematic diagrams showing several variations of the single-side coupling structure of FIG. 16A. In FIG. 16B, the bent extension structure is only formed at one edge of the lower resonator, and the upper resonator is still a planar resonator. In FIG. 16C, the bent extension structure is only formed at one edge of the upper resonator, and the lower resonator is still a planar resonator. FIG. 16D shows a structure that the bent extension structure is formed at one edge of the upper resonator, and the bent extension structure is also formed at another edge of the lower resonator, where the bent extension structures of the upper and lower resonators are combined together. The method of manufacturing the bent extension structures in FIGS. 16A to 16D is similar to FIGS. 15B to 15C.

Figure 17:
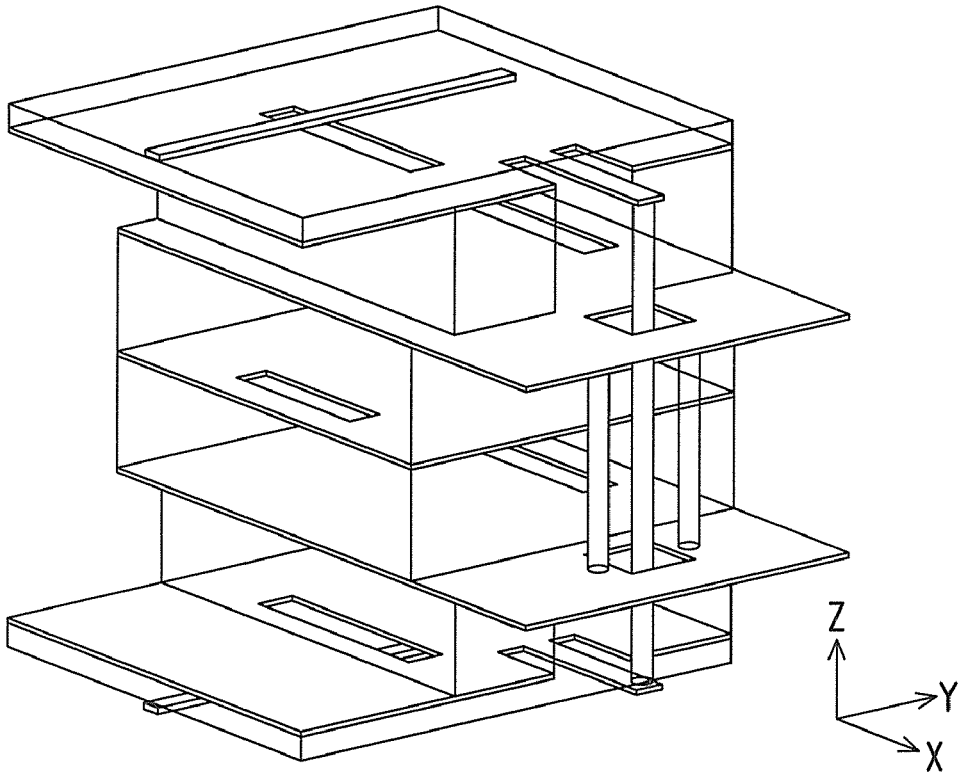
FIG. 17 is a schematic diagram illustrating a configuration of a four-stage band-pass filter according to the application.
Figure 18:
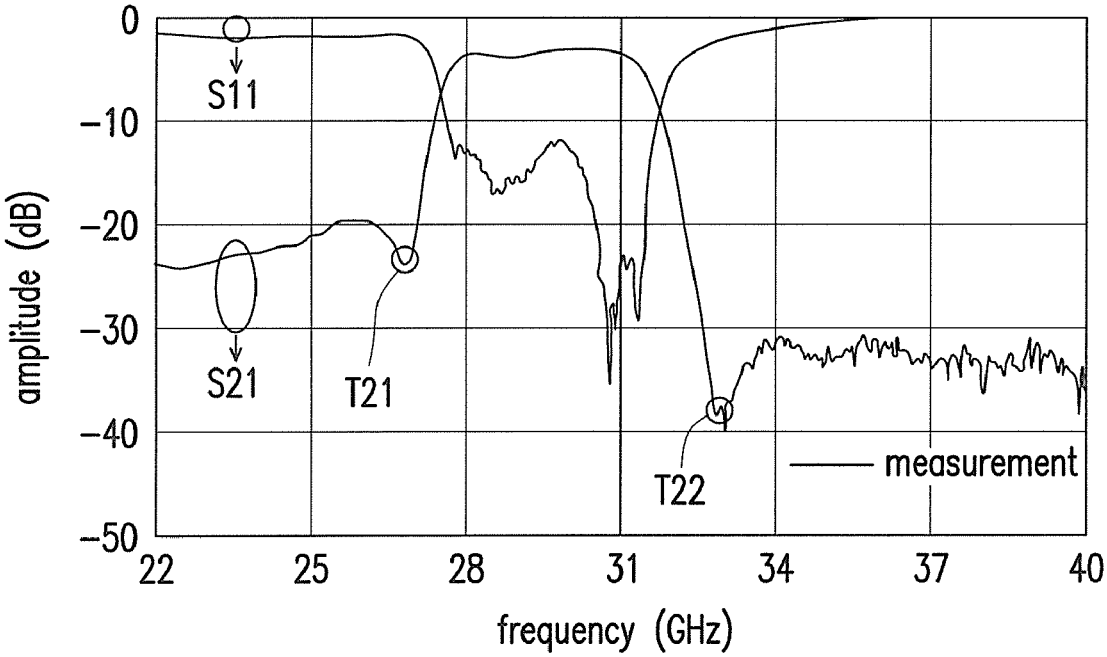
FIG. 18 is a schematic graph illustrating a frequency response of the S parameters for transmission and reflection (S21 and S11, respectively) in FIG. 17.

FIG. 17 is a schematic diagram showing a structure of a four-stage band-pass filter according to the application. The coupling structure for non-adjacent resonators in the four-stage band-pass filter will be described with reference to the embodiment shown in FIG. 10. FIG. 18 is a schematic graph showing a frequency response of S parameters for transmission and reflection (S21 and S11, respectively) in FIG. 17. From top to bottom in FIG. 17, the upmost resonator and the lowermost resonator are formed as a non-adjacent coupling structure. A LTCC structure is adapted for the above filter, where the LTCC structure comprises 16 layers and has a thickness of 2 mils for each layer. The loss tangent of the LTCC material is about 0.0075, the dielectric constant is about 7.8, and the plane size of the filter is less than 145 mil×179 mil. The center frequency is 29.5 GHz, the bandwidth is 3.93 GHz, the pass-band loss is less than 2.8 dB, and there are two transmission zeros TZ1 and TZ2 respectively disposed at the two sides of the pass-band frequency band.

Figure 19:
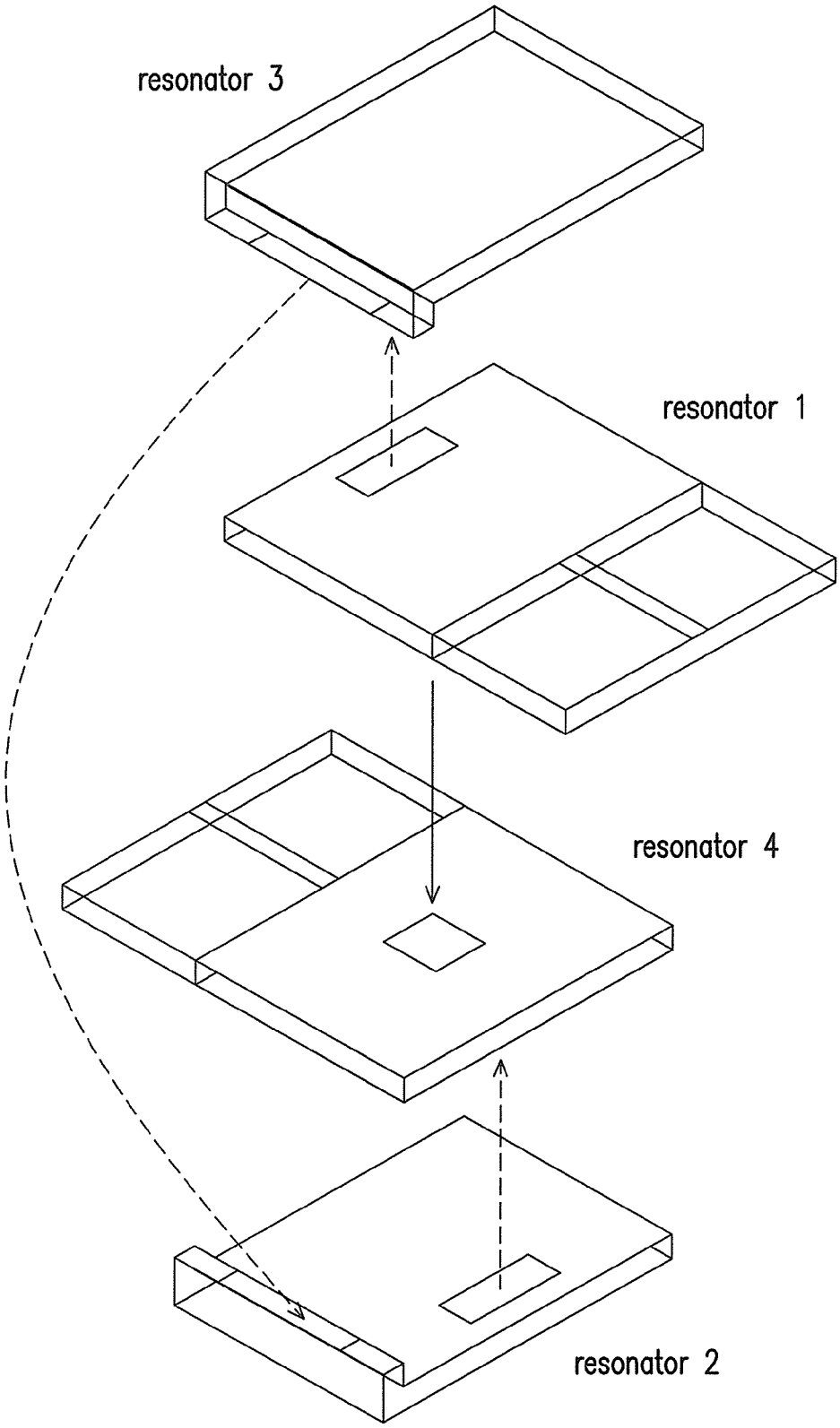
FIG. 19 is a schematic diagram illustrating a configuration of another four-stage band-pass filter according to the application.
Figure 20:
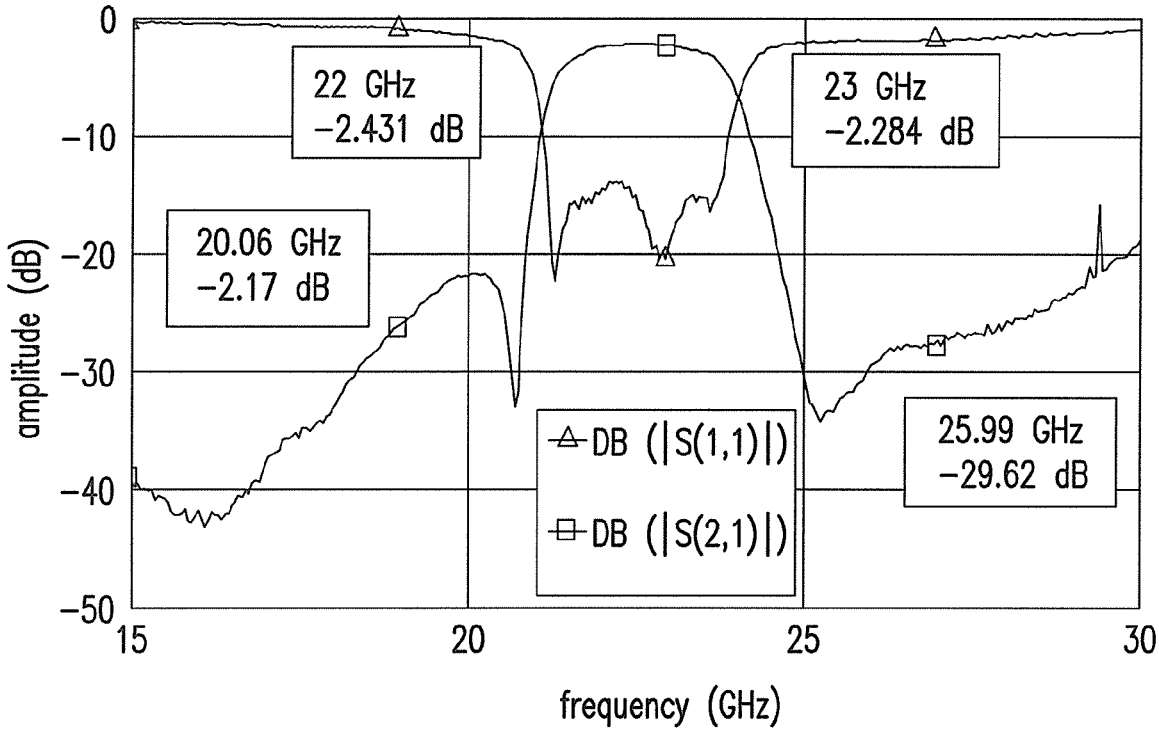
FIG. 20 is a schematic graph illustrating a frequency response of S parameters for transmission and reflection (S21 and S11, respectively) in FIG. 19.

FIG. 19 is a schematic diagram illustrating a four-stage band-pass filter that is implemented by using the non-adjacent resonator coupling structure shown in FIG. 15. FIG. 20 is a schematic graph illustrating a frequency response of S parameters for the transmission and reflection (S21 and S11, respectively) in FIG. 19.

The main coupling paths for the four-stage band-pass filter in FIG. 19 are magnetic couplings (shown in dotted line), including a coupling of non-adjacent resonators. The staggered coupling is achieved by forming slots on the metal surfaces of the resonators 1 and 4. Since the electric field is strongest in the slot, the staggered coupling is an electric field coupling. In this way, two transmission zeros are respectively formed at the two sides of the pass-band frequency band. A LTCC structure is adapted for the filter. The LTCC structure has 16 layers, and each layer has a thickness of 2 mils. The loss tangent of the LTCC material is about 0.0075, the dielectric constant is about 7.8, and the plane size of the filter is less than 140 mil×160 mil. As shown in FIG. 20, the measured center frequency is 22.5 GHz, the bandwidth is 1 GHz, and the pass-band loss is less than 2.5 dB.

In summary, the application provides several coupling methods for cross layers when the resonators are vertically stacked. These methods are compliable comply with the existing multilayer substrate process, and can be easily designed and implemented. Therefore, performance of the frequency selection element can be increased without adding cost.

It will be apparent to those skilled in the art that various modifications and variations can be made to the structure of the application without departing from the scope or spirit of the application. In view of the foregoing, it is intended that the application cover modifications and variations of this application provided they fall within the scope of the following claims and their equivalents.

What is claimed is:

1. A vertical coupling structure for non-adjacent resonators, comprising:

a first resonator, wherein at least one side of the first resonator is formed as a first bent extension structure, and the first bent extension structure comprises a slot; and a second resonator, wherein the second resonator is not adjacent to the first resonator, and a side of the second resonator opposite to the first bent extension structure of the first resonator further comprises a slot, such that the two sides are electrically connected.

2. The vertical coupling structure for non-adjacent resonators according to claim 1, wherein the side of the second resonator is formed as a third bent extension structure; and the first bent extension structure of the first resonator is electrically connected to the third bent extension structure of the second resonator.

3. The vertical coupling structure for non-adjacent resonators according to claim 1, wherein the first and the second resonators are a substrate integrated waveguide (SIW) resonator.

4. The vertical coupling structure for non-adjacent resonators according to claim 3, wherein the SIW resonator is formed by a multilayer substrate process.

5. The vertical coupling structure for non-adjacent resonators according to claim 1, wherein the other side of the first resonator is formed as a second bent extension structure; and the side of the second resonator opposite to the other side of the first resonator is formed as a bent extension structure.

6. The vertical coupling structure for non-adjacent resonators according to claim 5, wherein the side of the second resonator is formed as a third bent extension structure;

the first bent extension structure of the first resonator is electrically connected to the third bent extension structure of the second resonator; and the second bent extension structure of the first resonator is electrically connected to the other side of the second resonator.

7. The vertical coupling structure for non-adjacent resonators according to claim 5, wherein the two sides of the second resonator are respectively formed as a third bent extension structure and a fourth bent extension structure;

the first bent extension structure of the first resonator is electrically connected to the third bent extension structure of the second resonator; and the second bent extension structure of the first resonator is electrically connected to the fourth bent extension structure of the second resonator.

* * * * *